United States Patent [19]

Davis et al.

[11] Patent Number: 4,680,911

[45] Date of Patent: Jul. 21, 1987

[54] DECORATIVE WALL COVERING

[76] Inventors: Richard A. Davis, 1251 NW. 165th St., Miami, Fla. 33169; Wilfrid E. Davis, 800 E. Northwest Hwy., Palatine, Ill. 60067

[21] Appl. No.: 865,284

[22] Filed: May 21, 1986

[51] Int. Cl.[4] ..... E04D 1/26; E04D 1/34

[52] U.S. Cl. ..... 52/521; 52/519; 52/520; 52/536; 52/539; 52/555

[58] Field of Search ..... 52/519, 520, 521, 523, 52/546, 555, 525, 526, 527, 535, 536, 539

[56] References Cited

U.S. PATENT DOCUMENTS

| | | | |
|---|---|---|---|
| 569,002 | 10/1896 | Boehm | 52/539 |
| 1,986,829 | 1/1935 | Klimsza | 52/314 |
| 2,735,143 | 2/1956 | Kearns | 52/521 |
| 3,217,453 | 11/1965 | Medow | 52/314 |
| 3,238,687 | 3/1966 | Tisbo | 52/520 |
| 3,613,326 | 10/1971 | Mollman | 52/314 |
| 3,621,625 | 11/1971 | Medow | 52/314 |
| 3,783,570 | 1/1974 | Storch | 52/553 |
| 3,897,667 | 8/1975 | Turek | 52/546 |
| 3,968,610 | 7/1976 | Medow | 52/539 |
| 4,015,391 | 4/1977 | Epstein et al. | 52/539 |
| 4,070,843 | 1/1978 | Leggiere et al. | 52/521 |
| 4,102,106 | 7/1978 | Golder et al. | 52/546 |
| 4,223,490 | 9/1980 | Medow | 52/314 |
| 4,450,665 | 5/1984 | Katz | 52/546 |
| 4,522,002 | 6/1985 | Davis et al. | 52/521 |

FOREIGN PATENT DOCUMENTS

| | | | |
|---|---|---|---|
| 2440497 | 3/1976 | Fed. Rep. of Germany | 52/314 |

*Primary Examiner*—William F. Pate, III
*Assistant Examiner*—Michael Safavi
*Attorney, Agent, or Firm*—Richard M. Saccocio

[57] ABSTRACT

Decorative wall covering panels are disclosed which sealingly fit against a wall and thereby protect the wall surface from the deteriorating effects of weather. Horizontally and vertically abutting panels which simulate real shingles, such as cedar shake shingles, overlap each other on all edges when installed. Sealing surfaces are provided around the periphery of the inside surface of the panels. The fitting arrangement of the overlapping edges between panels serves to make and maintain the seals between the panels and the wall.

6 Claims, 6 Drawing Figures

DECORATIVE WALL COVERING

BACKGROUND OF THE INVENTION

1. Field of the Invention

The present invention relates in general to the field of wall coverings and in particular to the field of decorative wall coverings which are primarily intended to be used outdoors and function to protect the base wall from the deteriorating effects of the elements of nature.

2. Description of the Prior Art

Providing a plain wall surface with an aesthetically-pleasing covering has been a long time goal of man. Further, providing such a decorative wall covering in an environment whereby the wall and the covering are exposed to the harsh elements of nature has also been a long time goal and one which is obviously much more difficult to attain than where the wall covering is, for example, used indoors. The problem is even more complicated when an added requirement comprises protecting the base wall from the deteriorating effects of the environment. Still today, the search for such wall coverings continues. The myriad number of natural and synthetic wall coverings in use today is a tribute to this long-standing search. Yet, even with today's so-called space age materials, a fully satisfactory solution to the problem has yet to be attained. The present invention, however, comprises a wall covering which is both decorative and useful and overcomes many of the prior art problems in this field.

The prior art is primarily exemplified by U.S. Pat. No. 4,522,002, which patent comprises our prior efforts to overcome the above-stated prior art problems. In that patent, we previously addressed the state of the then prior art and the various attempts to overcome the problems of proper installation while providing for expansion and contraction of the panels due to changes in the temperature. For example, it was previously stated that overcoming the effects of thermal expansion of the panels is a critical factor in providing a wall panel because panels will expand as much as five-eighths of an inch over a forty-inch length of panel at temperatures of 160° Fahrenheit. Such temperatures are easily attained on hot, sunny days because, in part, of the heat-sink and hot house effect of panels covering a surface such as a wall or a roof and which are spaced from said wall or roof by a discrete distance leaving a stagnant air space therebetween. Also as previously explained, various types of expanding joints have been built into the panels so that the panels can expand without buckling away from the walls on which the panels are mounted. Generally, in the prior art, expandable tongue-and-groove joints were used in conjunction with breakable pins. The pins are provided for purposes of installation which functions as a stop between panels when adjacent panels are mounted to the wall during installation. Then, when subject to thermal expansion, the pins are allowed to break and the tongue is allowed to further engage within its associated groove. This system of interlocking panels, as explained, suffered from loose tongue and grooves which allowed rattling of the panels after installation and, for example, when subject to even mild wind conditions.

Accordingly, our previous U.S. Pat. No. 4,522,002, particularly addressed the problem of thermal expansion. Our previous patent materially overcame many of the prior art problems and represents a significant improvement in the state of the art of decorative all panels.

One aspect of our prior patent comprised the contribution of utilizing a material made of polypropylene with twenty percent (20%) calcium carbonate filler which composition of matter significantly decreased the thermal co-efficient of expansion and contraction as compared to prior art materials. Another aspect of our prior patent comprised providing flexible pins to bear on a tongue in a tongue-and-groove interlock as regards horizontal expansion joints and the tongue-and-groove interlock in combination with ramping surfaces for a bendable flange to slide over and bear on for vertical expansion joints which combination was substantially tight and rattle free under prevailing outdoor conditions.

There are times, however, when severe wind and rain occur together which causes the rain to accelerate and thereby penetrate further than normal. Under these adverse conditions, the wind causes slight lifting of the bottom horizontal edge of the decorative wall panels and allows the penetrating rain to enter underneath the wall panel and become trapped in the space between it and the wall. Once water enters this stagnant air space, it is very difficult to drive the moisture therefrom. Accordingly, an object of the present invention is to provide a decorative wall panel which prevents water from entering underneath the horizontal lower edge and forming a high humidity condition within the stagnant air space between the wall panel and the wall.

Another object of the present invention is to provide a decorative wall panel which prevents wind from lifting and water from entering the vertical joint between adjacent panels.

Another object of the invention include providing a decorative wall covering which allows for easy and foolproof installation whereby horizontal and vertical alignment between panels is easily attained and maintained.

Another object of the present invention is to provide a decorative wall panel which allows for both horizontal and vertical contraction and expansion while maintaining the aforesaid moisture barrier between adjacent panels.

SUMMARY OF THE INVENTION

The above objects as well as others are accomplished by the present invention which is directed to a decorative wall covering which in the example exemplified herein comprises a simulated cedar-shake shingle made from the composition of matter having a polypropylene base and a twenty percent (20%) calcium carbonate additive. A unique moisture seal in combination with an expansion joint is provided at the lower horizontal end of the upper panel and the upper horizontal end of the lower panel. A fully extending horizontal top seal is provided on the wall side of the lower panel below the nail holes. Similarly, a fully extending bottom seal is provided above tongue-and-groove joints on the wall side of the upper panel. Finally, the extreme lower edge of the upper panel, notwithstanding an uneven simulated cedar-shake shingle effect, is provided with a substantially flat inside surface which abuts up against the flat outer surface of the lower abutting panel so as to complete the moisture barrier.

The side or lateral abutting edges of adjacent panels are also provided with a moisture-proof barrier, yet one that allows for lateral or horizontal expansion and contraction. A pair of vertically-oriented side edges overlap each other to form said vertical expansion joint and moisture barrier.

Various other objects, advantages and features of the invention will become apparent to those skilled in the art from the following discussion taken in conjunction with the following drawings, in which:

DESCRIPTION OF THE PREFERRED EMBODIMENTS

Figure 1:
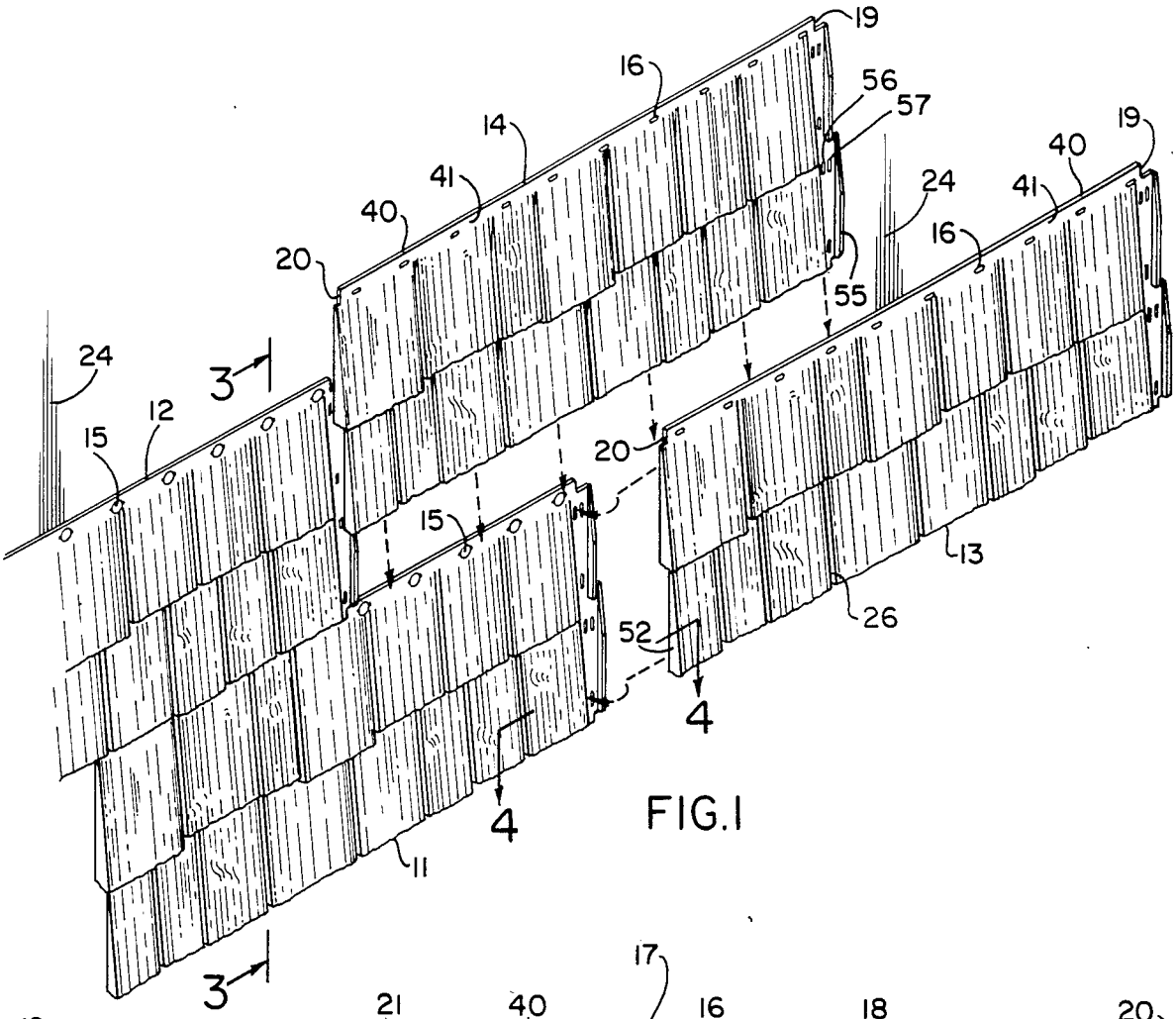
FIG. 1 is a isometric partially exploded rendering of the inventive wall covering with some of the panels being shown in place against the wall to which they are attached and with other panels separated therefrom and in spaced relation to said in-place panels to illustrate the method of installation.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings where like characteristics among the various figures are denoted by the same reference numerals.

FIG. 1 illustrates, in perspective, the installation sequence of one embodiment of a portion of a decorative wall covering as contemplated by the present invention. The type of panel shown in FIG. 1 comprises a simulated cedar-shake shingle arrangement. Two horizontal rows of wall panels are depicted with each row having two side-by-side wall panels. Of course, a completed wall arrangement would involve many more panels, but the drawings show only four for the purposes of clarity and covenience. In FIG. 1, panel 11 and panel 12 are shown in the installed position. Wall panel 13 is shown ready to be installed in a horizontal abutting relationship with wall panel 11. Wall panel 14 is shown ready to be installed in a vertical abutting relationship with wall panel 12 and a horizontal abutting relationship with panels 11 and 13. Wall panels 11 and 12 have been installed to a wall by means of nails 15 or other appropriate fasteners which are inserted through horizontally-elongated holes 16 in the panels. Accordingly, the panels 11 and 12 show the heads of nail 15 while, wall panels 13 and 14 show the holes 16 along a horizontal line at the approximate top end of the wall panels. The details of the vertically abutting arrangement as well as the horizontal abutting arrangement of the wall panels will be more fully described hereinafter.

Figure 2:
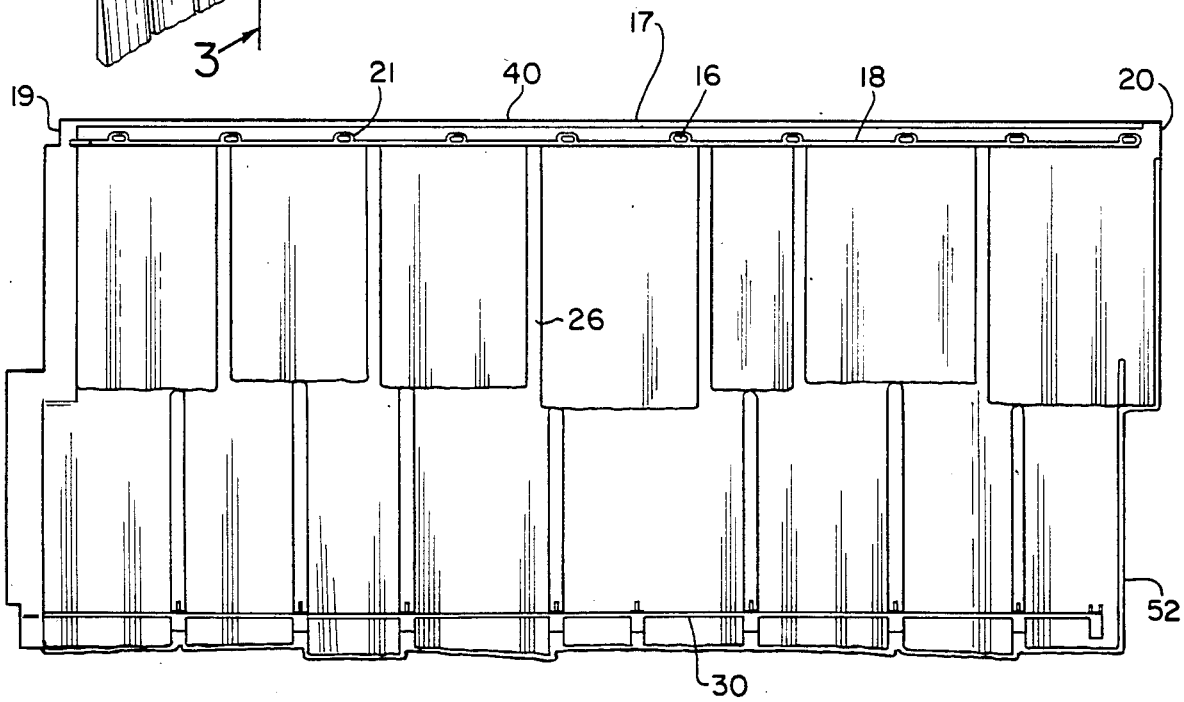
FIG. 2 is a rear elevation of one inventive panel as viewed from the wall side thereof.
Figure 3:
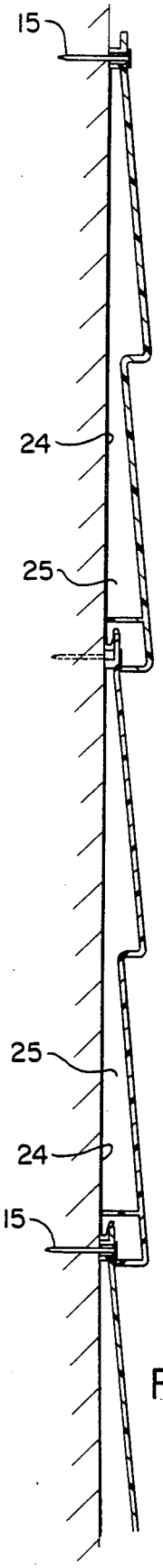
FIG. 3 is a vertical section through wall panels of FIG. 1 taken through the line 3—3 thereof.
Figure 6:
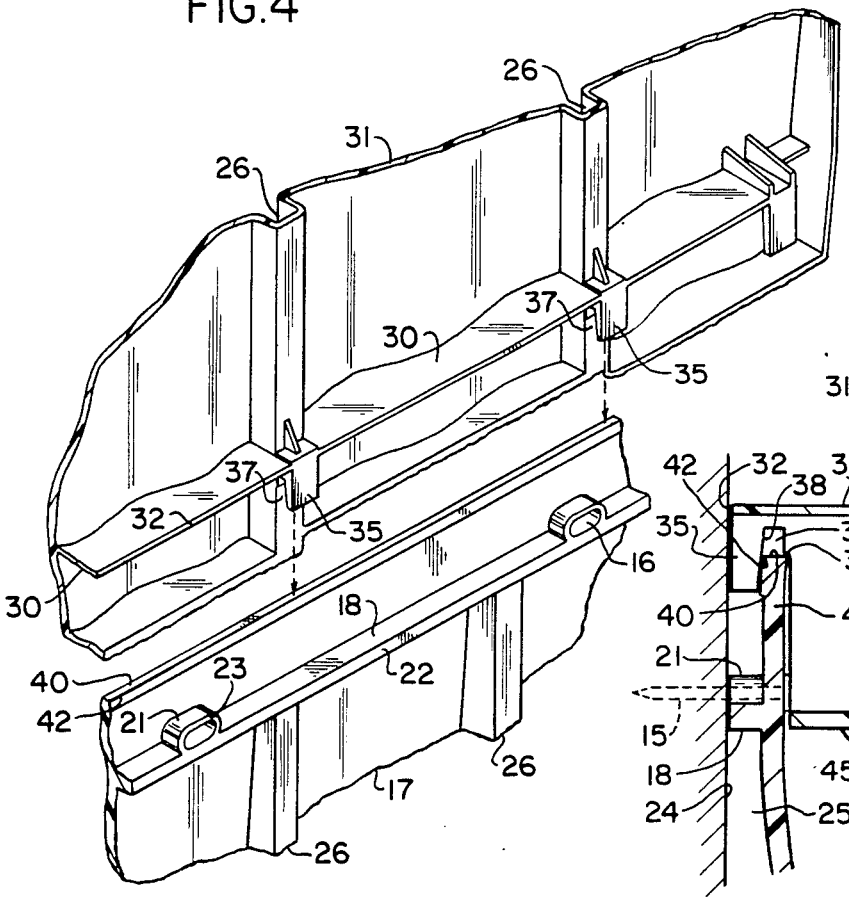
Figure 5:
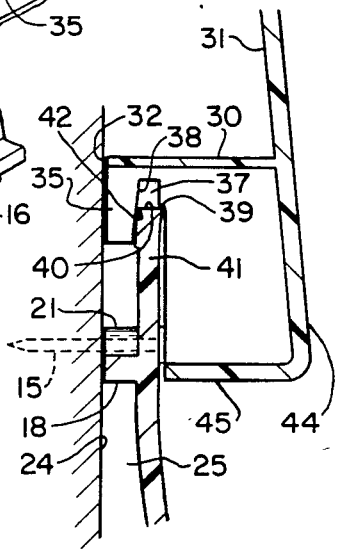
FIG. 5 is an enlarged cross-sectional detail of the moisture barrier of horizontally abutting wall panels; and, FIG. 6 is an enlarged exploded perspective view of the moisture barrier arrangement according to the present invention as viewed from the wall side of horizontal abutting wall panels.

FIG. 2 illustrates a rear-elevational view of a typical decorative wall panel 17. It is, of course, to be understood that the invention is not limited to a simulated cedar-shake shingle configuration, but may comprise any of the well-known decorative and functional wall coverings that are commonly known and used for either indoor or outdoor use. Since wall panel 17 is molded from a combination polypropylene and calcium carbonate additive and since a light-weight, relatively thin product is desirable, the view of the wall panel shown in FIG. 2 also shows the pattern of the simulated cedar-shake shingles from the rear. The decorative surface finish of the simulated shingles which exist on the front of the panel does not, of course, exist on the rear of the panel. Along the top horizontal end of panel 17 a top seal 18 is provided slightly below the openings 16 for fasteners 15. Top seal 18 extends to vertical ends 19 and 20 such that when another panel is placed on either side of panel 17 along a horizontal row, top seal 18 forms a continuous horizontal seal therealong. As also can be seen in FIGS. 5 and 6, top seal 18 comprises a horizontally-extending flange extending from the back surface of the front of wall panel 17. Openings 16 or fasteners 15 are elongated in a horizontal direction so as to accomodate thermal expansion and contraction of panel 17 relative to the fixed position of nails 15.

As is clearly shown in FIG. 6, openings 16 are within and through an oval shaped structure 21 which extends from the back surface of the front of the wall panel 17 to the vertical surface 22 of top seal 18. Accordingly, surfaces 22 and 23 lay along the same vertical plane. Also to be noted is the closeness of opening 16 relative to top seal 18. In this manner when panel 17 is fastened to a wall surface by fasteners 15 the vertical surface 22 of top seal 18 fits tightly against and flush with wall surface 24. Top seal 18 thusly comprises a seal which cannot be lifted away from wall 24 by even harsh weather conditions and comprises and functions as a moisture barrier which prevents water and moisture from passing in either an upward or downward direction relative to the location of seal 18. Accordingly, seal 18 prevents moisture from getting into the stagnant air space 25 between panel 17 and wall 24 through the upper end of wall panel 17. The extending depth of top seal 18 may be of the order of one-quarter to one-half inch and have a thickness of approximately one-eighth to one-quarter of an inch. Additional stiffness may be given to top seal 18 by integrally connecting the hole structures 21 as well as the vertical ribbing 26 comprising the simulated joint between adjacent individual shake shingles as shown in FIG. 6. By utilizing this construction, top seal 18 comprises a very effective seal which seals against moisture and water even under the most adverse weather conditions.

Still referring to FIGS. 2, 5 and 6, a lower seal 30 is provided in a horizontal direction along the lower end of a wall panel such as panel 31. It should be noted at this time that wall panels 11, 12, 13, 14, 17, and 31 are all exact duplicates of each other. The only reason for utilizing different reference numerals for these like components is to allow the reader to more easily follow that which is being explained and disclosed herein. Lower seal 30 extends in a horizontal plane from the inside of the front of the lower end of wall panel 31. Since cedar-shake and other like shingles typically vertically overlap each other and therefore are each positioned at a angle to a flat wall surface, the lower end of a shingle tends to be further away from the wall than the upper end of the shingle and, therefore, lower seal 30 has a greater depth dimension than upper seal 18. The relative depths of the seals are clearly shown in FIGS. 5 and 6.

As installed, it is intended that the vertical edge 32 of lower seal 30 fits substantially flush and against wall surface 24. This is most clearly shown in FIG. 5 wherein it is also seen that a connecting tab 35 extends down from lower seal 30 at each location of the side-by-side simulated joints 26 but is separated therefrom to form a groove 37 therebetween. The lower inside surface of each of the tabs 35 are provided with an angled or ramped surface 38 which terminates at the upper end of groove 37. A small ledge 39 on the other side of groove 37 forms a series of horizontally aligned surfaces which together form a stop for the upper horizontal edge 40 of lower panel 17. Accordingly, ledges 39 allow an installer to position each upper panel, such as panel 31 relative to a lower panel 17, at a precise and horizontally aligned location relative to each other. The ramped surfaces 38 allow the lower end of panel 31 to be initially located a small distance away from wall surface 24 for ease of fitting an upper panel to a lower panel. But, as an upper panel 31 is being lowered, the inside edge 42 of surface 40 contacts ramp surface 38 and progressively pushes the lower end of panel 31 against wall surface 24 until and whereby the vertical surface 32 of lower seal 30 firmly abuts with wall surface 24 to form a seal at this location. At the finally-installed location, shown in FIG. 5, it can be seen that the upper vertically-extending upper end 41 of panel 17 is slightly bowed, which bow provides the positive force to seat upper seal 30 against wall 24.

Also to be noted in FIG. 5 is that a portion of groove 37 extends further upward of surface 40 of upper end 41 of panel 17. This additional depth of groove allows for relative thermal expansion between upper and lower panels 31 and 17. In this regard, ledges 39 may have a small depth of the order of 0.010 inches which is sufficient to provide the installer with a positive indication that an upper panel 31 is properly seated relative to a lower panel 17 but yet such that the resiliency and deformability of the material from which the panels are made allows upper end 41 of panel 17 to move past ledge 39 and further into groove 37 during relative expansion between panels. The continuing force of upper end 41 on ramped surfaces 38 assures the positive sealing fit between upper seal 30 and wall 24 during periods of relative expansion. On the other hand, during periods of contraction, the still present bow in upper end 41 in combination with ramp surfaces 38 also provides for a positive seal between lower seal 30 and wall 24. Lower seal 30, therefore, provides an effective moisture barrier which prevents water or moisture from entering the stagnant air space 25 from the lower end of the panels.

The lower skirt portion 44 of upper panel 31, below seal 30, is provided with a horizontally-extending flange portion 45 so as to cover nails 15 as well as provide an additional barrier which prevents wind and rain from entering between the joint between upper and lower panels. In this manner the moisture barrier provided by seals 18 and 30 are made more effective because they are in series with the moisture barrier provided by skirt portion 44 and horizontal flange 45. In other words, before any moisture passes seals 18 and 31, it must first pass portions 44 and 45. The resulting configuration further prevents rattling of the installed panels and lifting thereof during windy conditions.

Figure 4:
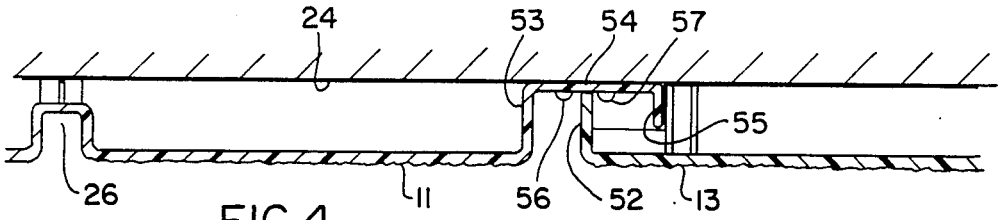
FIG. 4 is a horizontal section through the wall panels of FIG. 1 taken through the line 4—4 thereof.

FIGS. 1 and 4 show one embodiment whereby horizontally-adjacent wall panels are interlocked with each other. In the example shown the right side of a typical wall panel such as panel 11 is provided with a U-shaped channel configuration. The left side of a typical wall panel such as panel 13 is, on the other hand, provided with an inwardly-extending flange. The U-shaped channel comprises a first inwardly-extending surface 53, a flat surface 54 extending to the right thereof, and an outwardly-extending flange member 55 at the end of flat surface 54. When panel 11 is nailed to wall 24, flat surface 54 fits against wall 24 as shown in FIG. 4. When panel 13 is then nailed to surface 24, inwardly-extending flange member 52 presses against flat surface 54 to further force flat surface 54 against wall 24. The depth dimension of flange surface 52 may be slightly greater than the depth dimension of the U-shaped channel so as to cause the left side of panel 13 to bow outward while exerting an inward force against surface 54 to further assist in the seal between horizontally-adjacent panels 11 and 13.

Protrusions 56 and 57 are provided along the length of surface 54 and are spaced from each other such that during installation, flange member 52 fits therebetween. The horizontal distance between members 53 and 55 provides for horizontal expansion and contraction of panels 11 and 13 relative to each other.

In accordance with the above, it is seen that a decorative wall covering is provided which when installed on a wall or other suitable surface provides a very effective moisture seal completely around the stagnant air space behind each panel. Furthermore, the panels provided herein are substantially free and otherwise immune from adverse weather conditions such as extremes in temperature as well as blowing or windy weather conditions.

While the invention has been described, disclosed, illustrated and shown in certain terms or certain embodiments or modifications which is has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim as our invention:

1. A panel adapted to cover and to be sealingly engaged against a wall comprising top and bottom horizontal edge regions and left and right vertical edge regions sealing means along said top and bottom horizontal edge regions and along the left and right vertical edge regions for sealing the peripheral edges of said panel against said wall, said top horizontal edge region being sealed when said panel is fastened along its top region to said wall, said bottom horizontal edge region being sealed when the bottom horizontal region of said panel is interlockingly connected to the top horizontal region of a second panel positioned below said panel, one of said side vertical edge regions being sealed when said panel is overlappingly positioned over a side vertical edge region of a third panel positioned at the side of said panel, and the other of said side vertical edge regions being sealed when a side vertical edge region of a fourth panel is overlappingly positioned at the side of said panel, said bottom horizontal edge region sealing means comprising a flange member along the bottom length of said panel and extending substantially horizontally outward from a back surface of said panel thereby forming a straight and flat planar sealing surface, said flange member including a plurality of tab members attached to and spaced along the length of said flange member and extending in a vertical direction away from said top horizontal edge region forming a slot between said tab members and the back of said panel, said slots being positioned to engage the top horizontal region of said second panel and to sealingly position said flange member against said wall, each of said slots including a ramped, generally vertical, surface tapering in a direction from a top of said slot away from the back surface of said panel, whereby the lowering of said panel onto the top of said second panel causes the bottom horizontal sealing surface to progressively move toward and into sealing contact with said wall, each of said slots including a horizontal ledge along the surface of said slot opposite to the ramped surface whereby said panel is properly positioned horizontally with said second panel upon engagement of the top horizontal edge surface of said second panel with said plurality of ledges.

2. The panel of claim 1, wherein said top horizontal edge region sealing means comprises a flange member along the top length of said panel and extends substantially horizontally outward from said back surface of said panel thereby forming a straight and flat planar sealing surface.

3. The panel of claim 2, wherein said flange member includes a plurality of spaced openings through said flange member and through said panel to said wall.

4. The panel of claim 1, wherein each of said slots includes a further recessed opening above said ledge for thermal expansion of the top edge region of said second panel into said further recessed openings in said panel.

5. The panel of claim 1, wherein said vertical edge region sealing means comprises a U-shaped flange member vertically positioned at the side edge of said panel and a perpendicularly extending vertical flange member at the side edge of said fourth panel, said perpendicularly extending flange member fitting within and against the opening formed by the U-shaped flange member.

6. The panel of claim 5, including a plurality of vertically arranged projections on a middle portion of said U-shaped flange member to form vertically aligned spaces therebetween, said perpendicularly extending vertical flange member fitting within said spaces.

* * * * *